United States Patent [19]

Stanton et al.

[11] Patent Number: 4,808,035

[45] Date of Patent: Feb. 28, 1989

[54] PNEUMATIC RISER TENSIONER

[75] Inventors: Paul N. Stanton; Michael F. Cook, both of Houston, Tex.

[73] Assignee: Exxon Production Research Company, Houston, Tex.

[21] Appl. No.: 50,258

[22] Filed: May 13, 1987

[51] Int. Cl.[4] ..... E02B 17/00; E21B 43/01

[52] U.S. Cl. ..... 405/195; 166/355

[58] Field of Search ..... 405/195, 196, 224, 289; 254/29 R, 93 R; 175/5, 7; 166/354, 355, 359, 367

[56] References Cited

U.S. PATENT DOCUMENTS

| | | | |
|---|---|---|---|
| 3,760,875 | 9/1973 | Busking | 166/354 |
| 4,266,888 | 5/1981 | Bayer et al. | 405/195 X |
| 4,359,095 | 11/1982 | Goldsmith | 405/196 X |
| 4,379,657 | 4/1983 | Widiner et al. | 405/195 |
| 4,395,160 | 7/1983 | deJong | 405/195 |
| 4,432,420 | 2/1984 | Gregory et al. | 166/355 |

FOREIGN PATENT DOCUMENTS

| | | | |
|---|---|---|---|
| 223312 | 8/1959 | Australia | 405/289 |

OTHER PUBLICATIONS

"Drilling and Producing Operations Utilizing a Tension-Leg Platform", by R. E. Ireland et al., SPE Drilling Engineering, Oct. 1986, pp. 383-389.

"Riser Tensioners for a TLP Application", by F. H. MacPhaiden et al., OTC Paper 4985, May 1985, pp. 241-249.

*Primary Examiner*—David H. Corbin

*Attorney, Agent, or Firm*—Hubert E. Cox; Richard F. Phillips

[57] ABSTRACT

A system for supporting one end of a riser or other elongate element from a marine structure. In the preferred embodiment, a plurality of gas springs are symmetrically disposed about the upper end of a riser. The axis of compression of each gas spring is parallel to the axis of the riser. One end of each gas spring is secured to the riser and the other end of each gas spring is secured to the marine structure. Relative motion between the riser and marine structure along the riser axis is accommodated by contraction or extension of the gas springs. A gas reservoir can be provided to reduce pressure changes as the gas springs extend and contract. This reduces changes in the loading applied to the riser as the marine structure moves relative to the ocean bottom.

14 Claims, 5 Drawing Sheets

PNEUMATIC RISER TENSIONER

FIELD OF THE INVENTION

The present invention relates generally to equipment useful in offshore hydrocarbon exploration and production. More specifically, the present invention concerns a tensioner for supporting the upper end of a riser or other conductor from a buoyant offshore structure.

BACKGROUND OF THE INVENTION

A tension leg platform, generally referred to as a TLP, is a type of marine structure having a buoyant hull secured to a foundation on the ocean floor by a set of tethers. A typical TLP is shown in FIG. 1 of the appended drawings. The tethers are each attached to the buoyant hull so that the hull is maintained at a significantly greater draft than it would assume if free floating. The resultant buoyant force of the hull exerts an upward loading on the tethers, maintaining them in tension. The tensioned tethers limit vertical motion of the hull, thus substantially restraining it from pitch, roll and heave motions induced by waves, currents and wind. However, unlike conventional platforms which are rigidly attached to the subsea floor, TLPs are not designed to resist horizontal forces induced by waves. Thus surge, sway and yaw motions are substantially unrestrained, and in these motions, a TLP behaves much like a conventional semisubmersible platform.

One problem presented by offshore hydrocarbon drilling and producing operations conducted from a TLP or other floating platform is the need to establish a sealed fluid pathway between each borehole or well at the ocean floor and the work deck of the platform at the ocean surface. This sealed fluid pathway is typically provided by a riser, which commonly takes the form of a substantially vertical, tubular element. In drilling operations, the drill string extends through a drilling riser, the drilling riser serving to protect the drill string and to provide a return pathway outside the drill string for drilling fluids. In producing operations, a production riser is used to provide a pathway for the transmission of oil and gas to the work deck.

For TLPs and other floating platforms, special equipment known as a "riser tensioner" is required to maintain each riser within a range of safe operating tensions as the work deck moves relative to the upper portion of the riser. If a portion of the riser is permitted to go into compression, it could be damaged by buckling or by bending and colliding with adjacent risers. It is also necessary to ensure that the riser is not over-tensioned when the TLP hull moves to an extreme lateral position under extreme wave conditions or when ocean currents exert a significant side loading on the riser.

Most riser tensioners utilize hydraulically actuated cylinders with pneumatic pressure accumulators to provide the force necessary to maintain the upper portion of the riser within a preselected range of operating tensions. In one version, sheaves are attached to the buoyant drilling structure and tensioning cables are run over the sheaves and attached to the riser so that the riser is supported by one end of the tensioning cables. The other end of each tensioning cable is connected to a piston of an hydraulic cylinder. The hydraulic cylinders are connected to a relatively large accumulator which maintains the load applied by the cylinders at a relatively constant level over the full range of travel of the pistons. Thus, as the platform moves vertically, the pistons stroke to maintain a relatively constant upward loading on the riser. Typical of such a riser tensioner is that shown in U.S. Pat. No. 4,432,420, issued Feb. 21, 1984 to Gregory et al.

Another type of riser tensioner suitable for use on a TLP is described in U.S. Pat. No. 4,379,657 issued Apr. 12, 1983 to Widiner et al. Widiner also uses pneumatically pressurized fluid accumulators but eliminates the cables and sheaves used in earlier riser tensioners. Air and oil accumulators are connected to the cylinders to control the stroke of pistons. The piston rods are directly attached to a riser tensioning ring which supports the riser.

Both classes of riser tensioning systems described above rely on the use of hydraulic cylinders having sliding hydraulic seals. These seals have proven to be a troublesome maintenance item under offshore conditions. Damage to or failure of the seals can seriously degrade performance of the tensioner or render it altogether inoperative. These tensioning systems also require the use of hydraulic cylinders operating at pressures in excess of 6900 kPa (1000 psi). The use of a high pressure system presents several design and maintenance problems. It would be advantageous to provide a riser tensioner which avoids the need for sliding hydraulic seals and which has a lower operating pressure than those used heretofore.

SUMMARY OF THE INVENTION

A pneumatic riser tensioner is set forth for supporting a riser from a floating offshore platform and maintaining the upper end of the riser within a preselected range of tensile loadings during movement of the platform relative to the ocean floor. In the preferred embodiment, the tensioner has a support frame which includes a riser tensioning ring secured to the upper end of the riser. A mounting plate is pivotally secured to the platform. A plurality of gas springs are secured between the tensioning ring and the mounting plate in a symmetric array about the upper end of the riser. Each gas spring has a pneumatic chamber portion with elastomeric side walls. A valve is connected to the interior of the chamber for pressurizing the gas spring to a preselected level. Thereafter the valve is closed to seal the chamber. Movement of the platform relative to the riser causes the gas springs to contract or extend to accommodate the relative movement. The gas springs communicate with a gas reservoir to reduce the pressure change within the gas springs as they expand and contract in response to platform motion. This decreases variations in riser tension as the platform moves relative to the ocean bottom.

The riser tensioning system of the present invention avoids the need for sliding seals and operates at a considerably lower pressure than existing riser tensioning systems.

BRIEF DESCRIPTION OF THE DRAWINGS

For a better understanding of the present invention reference may be had to the accompanying drawings in which.

These drawings are not intended as a definition of the invention, but are provided solely for the purpose of illustrating certain preferred embodiments of the invention, as described below.

DETAILED DESCRIPTION OF THE PREFERRED EMBODIMENT

The invention includes at least one air spring assembly, a means for attaching one end of each air spring assembly to a TLP and a means for attaching the other end to the upper portion of a riser. The ends of the air spring are capable of contracting and extending with respect to one another and thereby accommodate relative movement of the TLP with respect to the riser while maintaining tension on the riser by virtue of the spring force. The preferred embodiment of the pneumatic riser tensioner of the invention is shown in FIG. 2.

Figure 1:
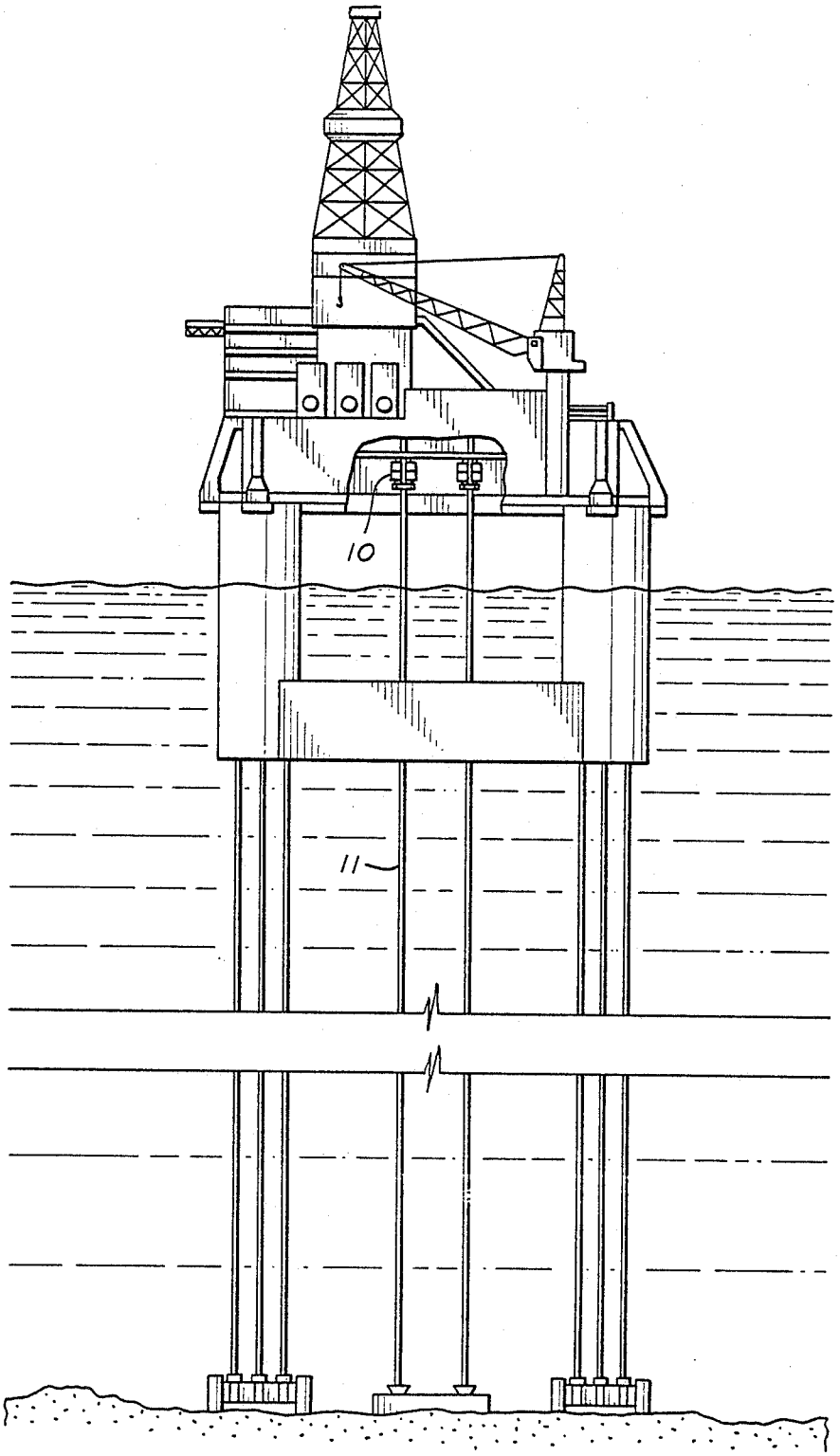
FIG. 1 is a pictorial drawing of a tension leg platform incorporating the riser tensioner of the present invention.
Figure 2:
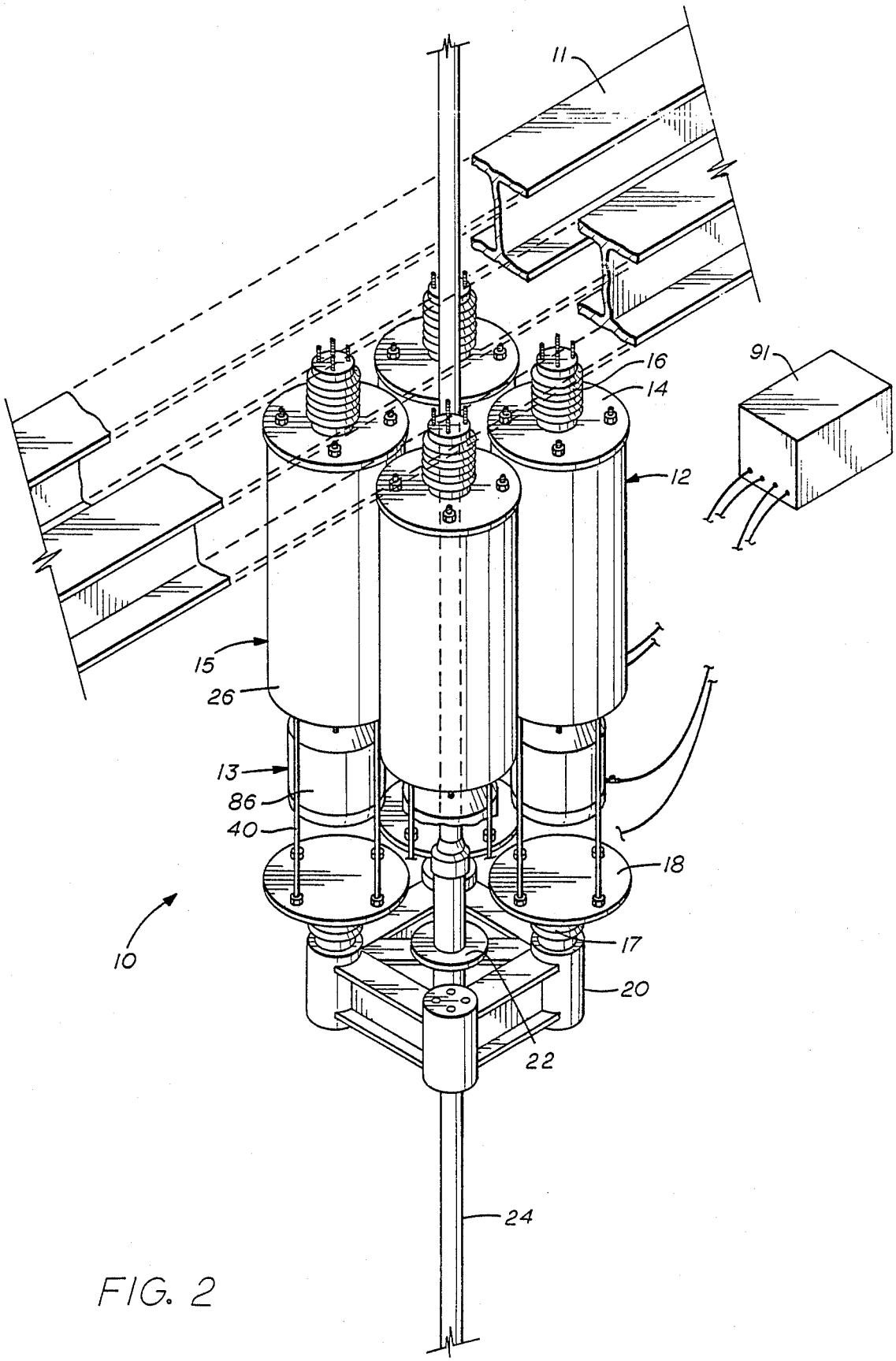
FIG. 2 is an isometric view of a preferred embodiment of the riser tensioner of the present invention.
Figure 3:
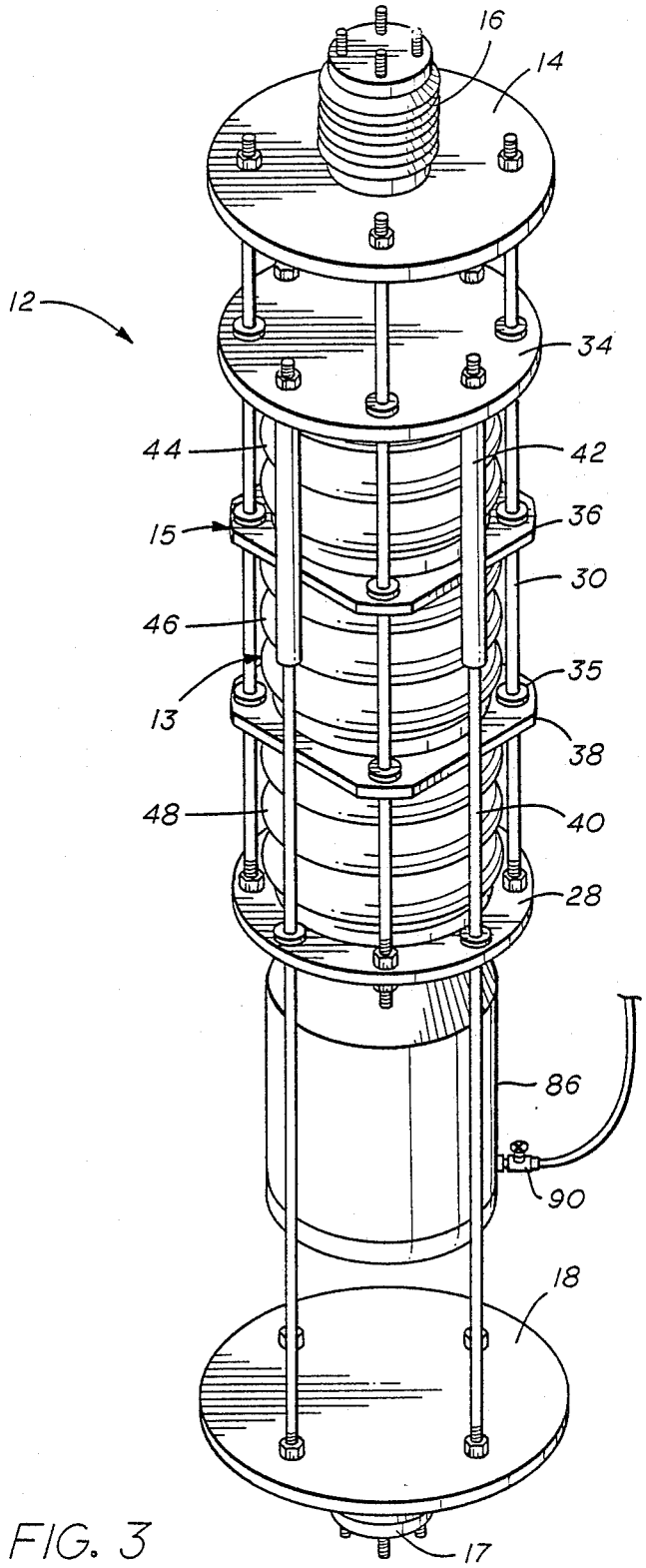
FIG. 3 is an isometric view of one of the air spring assemblies of FIG. 2, in this view the air spring assembly shroud has been removed for clarity.

FIG. 2 shows a pneumatic riser tensioner 10 which includes four air spring assemblies 12. Referring to FIG. 3, each air spring assembly 12 of the preferred embodiment includes an air spring 13 and a mounting assembly 15. In the preferred embodiment the mounting assembly 15 includes a mounting plate 14. A spherical bearing pivot joint 16 connects mounting plate 14 to the TLP hull structure 11. The mounting assembly 15 also includes riser support plate 18 to which is attached a second spherical bearing pivot joint 17 which in turn is attached to and supports in tension a riser support frame 20. Spherical bearing pivot joints 16 and 17 allow for yawing motion of the TLP and accommodate angular movement in the longitudinal or vertical alignment of the upper portion 24 of the riser relative to the TLP. Riser support frame 20 includes a riser tensioning ring 22 which may be secured to the upper portion of a riser 24 to support the riser in tension. The four air spring assemblies 12 are attached to riser support frame 20 so as to be equally spaced about riser tensioning ring 22. A detachable cylindrical protective shroud 26 (shown attached in FIG. 2 and removed in FIG. 3) is attached to mounting plate 14 and extends downward and is detachably affixed to the air spring lower end plate 28. Shroud 26 is detachable to provide ready access to the component parts of air spring assembly 12 for inspection, maintenance and repair.

Referring again to FIG. 3, mounting assembly 15 also includes a set of four rods 30. Rods 30 are equally spaced about and attached to mounting plate 14 and extend vertically downward passing through separate borehole passages 32 which are located around the peripheries of air spring upper end plate 34, upper guide plate 36 and lower guide plate 38. The lower ends of rods 30 are attached to air spring lower end plate 28. Rods 30 transmit forces between lower end plate 28 and mounting plate 14.

Mounting assembly 15 also includes a second set of four rods 40 which are spaced equally around and attached to the periphery of riser support plate 18. Rods 40 extend vertically upward from riser support plate 18 parallel to rods 30, passing through borehole passages 32 on the periphery of lower end plate 28, but passing externally to both guide plates 36 and 38. Rods 40 attach to the periphery of air spring upper end plate 34 and transmit force between upper end plate 34 and riser support plate 18.

Rods 30 and borehole passages 32 in guide plates 36 and 38 and in air spring upper end plate 34 prevent lateral movement of guide plates 36 and 38 and upper end plate 34 relative to mounting plate 14 and air spring lower end plate 28 while at the same time permitting guide plates 36 and 38 and upper end plate 34 to move longitudinally with respect to rods 30. Similarly rods 40 and borehole passages 32 in air spring lower end plate 28 prevent lateral movement of lower end plate 28 relative to upper end plate 34 and riser support plate 18 while permitting lower end plate 28 to move longitudinally with respect to rods 40. Restraining lateral movement of the guide plates 36 and 38 and the air spring upper and lower end plates 34 and 28 prevents buckling of the air spring assemblies 12.

To facilitate movement of rods 30 and 40 through the various borehole ranges 32, each of the borehole passages is lined with a bushing 35 of a suitable low friction material.

Affixed around the upper portions of each of rods 40 and attached to and extending downward from upper air spring end plate 34 is a sleeve 42. Sleeves 42 act as stops and prevent the downward longitudinal movement of upper end plate 34 relative to lower end plate 28 from moving closer together than a distance equal to the length of sleeves 42. Thus sleeves 42 limit the extent of contraction of air spring assembly 12. Sleeves 42 limit the maximum contraction of the air spring assembly which occurs when the tensioner stroke is at its most extended position. Minimum tensioner stroke corresponds to maximum extension of the air actuator assemblies. The maximum extension of the air actuator assemblies 12 is limited by upper end plate 34 contacting mounting plate 14 and nuts 15.

As shown in FIG. 3, the preferred embodiment of air spring 13 includes three elastomeric chamber sections: upper chamber section 44, middle chamber section 46 and lower chamber section 48. In the preferred embodiment, each of the elastomeric chamber sections 44, 46 and 48 is of a type sold by the Firestone Industrial Products Company of Noblesville, Ind. under the trademark AIRSTROKE and sometimes referred to as an air actuator. Each air actuator of the type preferred for chamber sections 44, 46 and 48 of the preferred embodiment of the invention is an air actuator 50 as shown in FIG. 4.

Figure 4:
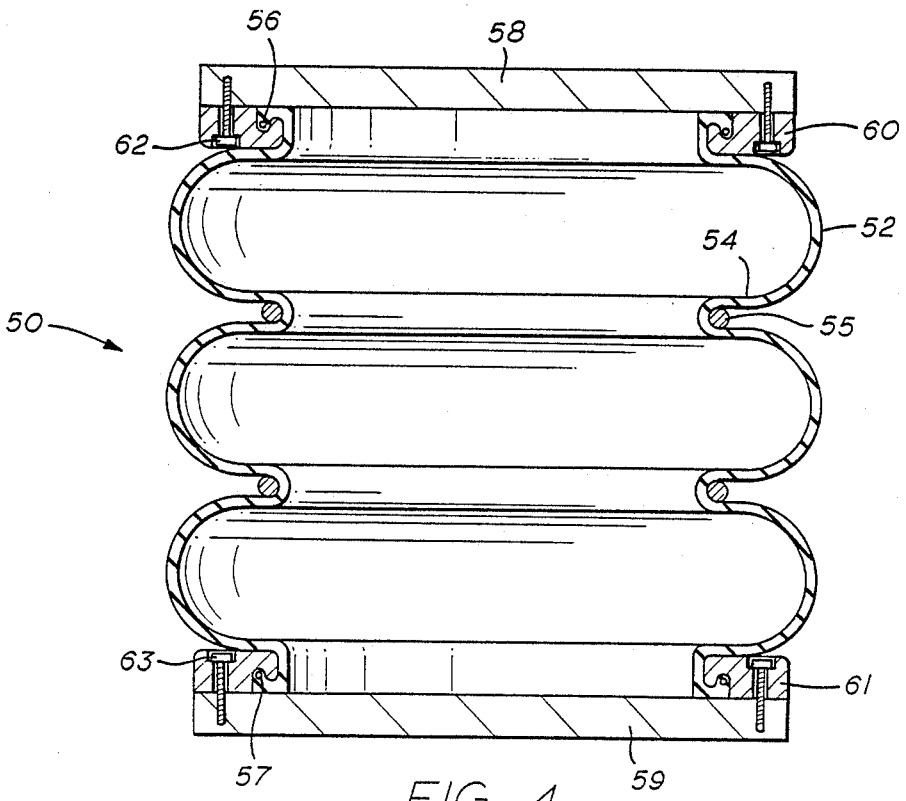
FIG. 4 is an axial cross section of the elastomeric air actuator used in the preferred embodiment of the invention.

Referring to FIG. 4, air actuator 50 is generally cylindrical with a corrugated or folded elastomeric wall 52 encircled by girdle hoops 54 molded into the elastomeric wall 52. Each girdle hoop 54 includes therein a circumferential wire wound or steel band 55 molded into the hoop. Molded into the top and bottom of elastomeric wall 52 are upper bead ring 56 and lower bead ring 57. Bead ring 56 includes a circumferential steel wire molded into the bead ring for facilitating attaching the end of elastomeric wall 52 in an airtight fashion to a rigid planar element as, for example, actuator upper end plate 58. A circular sealing ring 60, the inner surface of which is sized and curved to fit over bead ring 56, is used to place bead ring 56 in compressive contact with upper end actuator plate 58 by means of bolts 62 thereby effectuating an air tight seal between elastomeric wall 52 and actuator upper end plate 58. In a similar fashion, circular sealing ring 61 may be used to place bead ring 57 in sealing contact with actuator lower end plate 59 by means of bolts 63.

Figure 5:
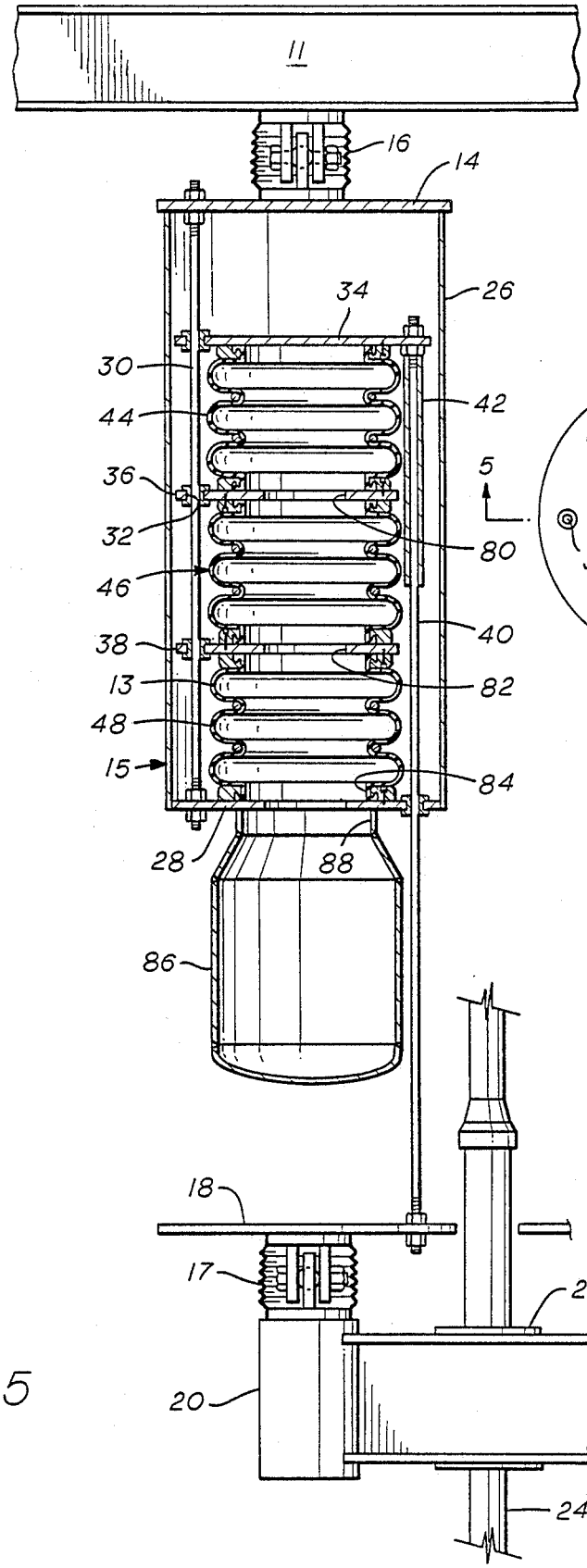
FIG. 5 is a view, partially in cross section, of the air spring assembly of FIG. 2, this view is taken along line 5—5 of FIG. 5A.
Figure 5A:
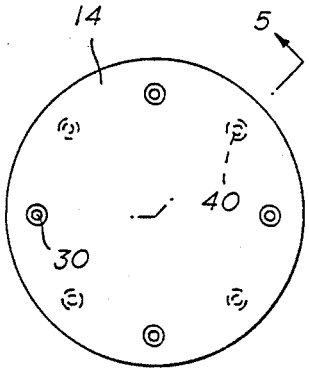
FIG. 5A is a lateral cross section corresponding to FIG. 5.

Referring to FIG. 5, in the preferred embodiment, upper chamber portion 44 is sealingly attached between the under side of air spring upper end plate 34 and the upper side of upper guide plate 36; chamber portion 46 is sealingly attached between the under side of upper guide plate 36 and the upper side of lower guide plate 38; and chamber portion 48 is sealingly attached between the under side of lower guide plate 38 and the upper side of air spring lower end plate 28, each in a manner similar to that discussed above with reference to air actuator 50 and actuator end plates 58 and 59 in FIG. 4. Guide plates 36 and 38 and air spring lower end plate 28 each has a central annulus therein, respectively 80, 82 and 84.

In the preferred embodiment of the air spring assembly 12, air can 86 is attached to the under side of air spring lower end plate 28. Air can 86 has an annulus 88 which surrounds or at least coincides with the edge of annulus 84. Thus an air tight chamber space is formed consisting of the air spring interior regions of each of elastomeric chamber portions 44, 46 and 48 and the annular regions 80, 82 and 84 of plates 36, 38 and 28 plus the interior volume of air can 86. Air can 86 is sized to obtain the desired dynamic response or spring constant of air spring 13 of air spring assembly 12. A valve 90 in the wall of air can 86 provides a means for moving air into and out of the air-tight chamber. The air-tight chamber space is pressurized to a desired preselected level by means of an air supply source 91 (shown in FIG. 2) and valve 90 is then closed. In this condition the sealed, pressurized, air tight chamber with its elastomeric side walls will operate as an air spring. That is, when air spring upper end plate 34 which is connected to and ultimately provides partial support to the upper portion of the riser, and air spring lower end plate 28 which is connected to a buoyant tension leg platform, move towards one another the volume of the sealed chamber contracts, compressing the air inside the chamber and increasing its pressure until the resistive forces exerted by the increased pressure against plates 28 and 34 equals the compressive forces exerted by plates 28 and 34. If thereafter, the upper portion of the riser moves upward relative to the buoyant platform, plates 28 and 34 will be moved away from each other due to the resistive force of the compressed air chamber, thereby expanding the volume of the chamber and reducing the pressure therein until the decreased opposing force on upper end plate 34 exerted by the pressurized air balances the tension in the riser.

As discussed above, in the preferred installation, four air spring assemblies 12 are used in the pneumatic riser tensioner and each of the four air spring assemblies is separately attached to the TLP. Typically the four air spring assemblies will be attached in pairs to one of two structural beam members of the TLP in an arrangement which when viewed from above forms a square with one air spring assembly 12 located at each corner. Each of the four air spring assemblies 12 supports riser tensioning ring 22 which is positioned at the center of the square pattern formed by the four air spring assemblies 12 when viewed from above. After the four air spring assemblies 14 and riser support frame 20 are installed, successive sections of the riser are connected together and lowered through the riser tensioning ring 22. Once a sufficient number of riser sections have been connected and lowered to form a riser which reaches from the buoyant TLP to a desired location at or near the sea floor, the riser is attached to a subsea wellhead. During the operations of connecting and lowering the riser sections and connecting the riser to a subsea wellhead, the upper portion of the riser is supported by a hoisting device such as a drilling or workover rig located on the TLP. After the riser has been connected to the seafloor, support of the riser is transferred from the hoisting device to pneumatic riser tensioner 10. This transfer is accomplished first by adjusting the attachment of the riser tensioning ring 22 to the riser so that each of the four air springs 13 are at an intermediate, though not necessarily center, stroke position. Then the pressure in each air spring is increased until the combined forces of the four air spring assemblies supporting the riser tensioning ring exerts the desired force on the riser. The hoisting device can then be disconnected from the riser.

After the tensioner has been pumped up to a pressure which results in the desired tension being applied to the upper portion of the riser, each air chamber formed by each air spring 13 together with air can 86 is sealed by closing valve 90. Thereafter as the air springs contract and extend to accommodate the relative motion between the top of the riser and the buoyant TLP, the volume of the sealed air chamber and the gas contained therein increases and decreases. This changing volume of a fixed mass of gas causes the pressure in the air spring to increase as the tensioner's four air springs contract and decrease when the air springs extend. This pressure change and the flexing of the elastomeric side walls of air springs 13 combine to make the tension force applied to the riser a function of tensioner stroke. The rate of change of tension with stroke is a design variable that is determined by the size of the sealed air chamber and the initial pressure.

Although the preferred embodiment includes a separate but integral air can 86, a separate air can is not a required element of the invention. The inclusion of an air can offers the advantage of a relatively inexpensive and easy means for achieving a desired size of a sealed air chamber. The air can may be sized to obtain the desired rate of change in applied tension which occurs with a change in stroke. Further, an air can, if desired, need not be integral to the air spring assembly but can be physically located on a deck or other convenient place on the TLP and connected by hose or pipe to the air chamber formed by the air actuator units. By locating the air can remotely from the air spring, the overall space required for installation of the invention may be reduced which may be desirable in some applications.

Figure 6:
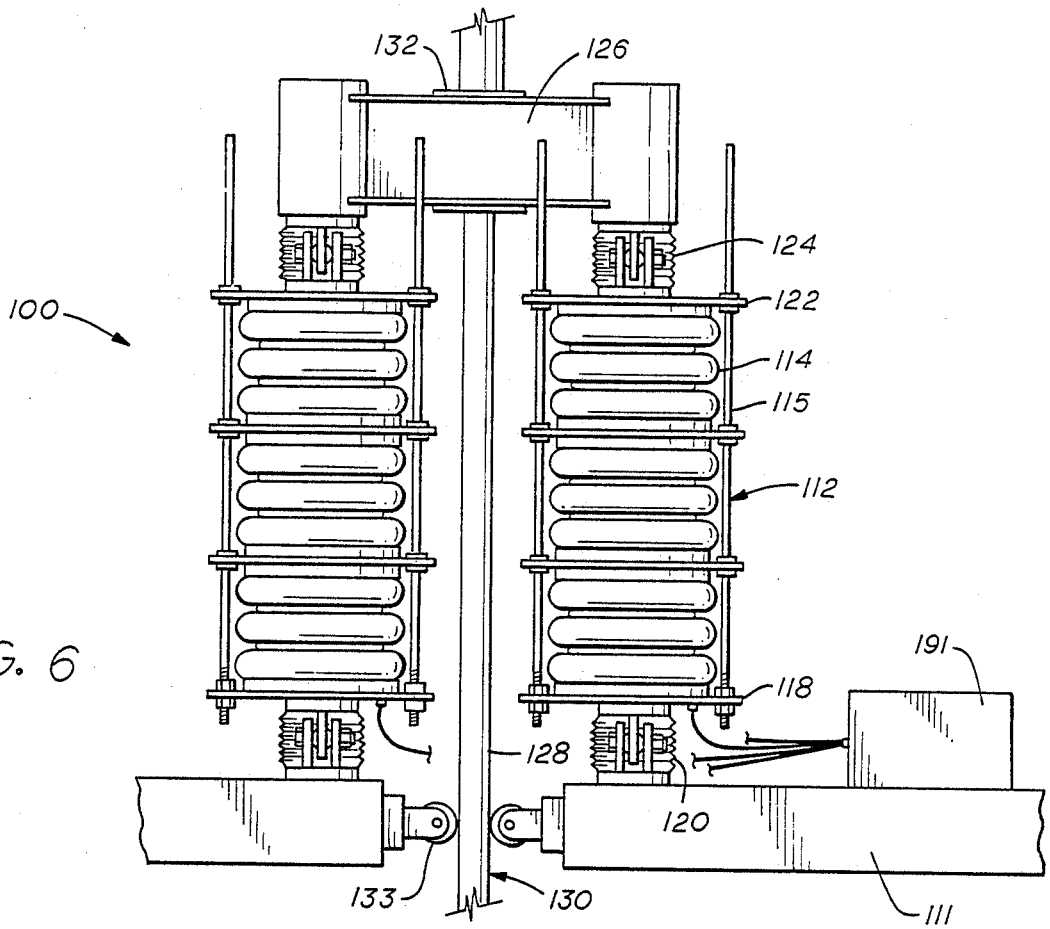
FIG. 6 is an elevational view of an alternate embodiment of the present invention, in this view the foremost and rearmost air spring assemblies have been removed for clarity.

An alternate embodiment of the invention is shown in FIG. 6. Referring to FIG. 6 there is shown a pneumatic riser tensioner 100 which includes four air spring assemblies 112 (only two of which are shown in FIG. 6, with the foremost and rearmost assemblies removed for clarity). Each air spring assembly 112 includes an air spring 114 and a mounting assembly 115. Mounting assembly 115 includes a mounting plate 118 and a first gimbal mount 120 for connecting mounting plate 118 to the TLP hull structure 111. Mounting assembly 115 also includes a riser support plate 122 to which is attached a second gimbal mount 124 which in turn is attached to a riser support frame 126. First and second gimbal mounts 120 and 124 allow for yawing motion of the TLP and accommodate angular movement of the longitudinal or vertical alignment of the upper portion 128 of riser 130 with respect to the TLP. Riser support frame 126 includes positioned at its center a riser tensioning ring 132 which for attaching the tensioner 100 to the upper portion 128 of the riser 130 and supporting the riser in tension. The four air spring assemblies 112 are attached by gimbals 124 to riser support frame 126 so as to be equally spaced about riser tensioning ring 132. A detachable shroud, not shown, may be attached if desired to riser support plate and may extend downward therefrom to offer protection to air spring 114 from damage due to contact with external objects.

Mounting assembly 115 also has a set of two rods 134. Rods 134 are placed opposite one another and attached to the periphery of mounting plate 118 and extend upward in a parallel fashion passing through separate borehole passages 136 which are located around the peripheries of lower guide plate 138, upper guide plate 140 and riser support plate 122. Rods 134 and borehole passages 136 prevent lateral movement of guide plates 136 and 138 and of riser support plate 122 while permitting plates 136, 138 and 122 to move up and down along rods 134 thereby preventing buckling of air spring assembly 112 as air spring 114 extends and contracts.

Air spring 114 includes a lower, middle and upper chamber portions, 144, 146 and 148 respectively connected together in an air tight manner by upper and lower guide plates 136 and 138. Each chamber portion is an elastomeric unit similar to that discussed above and shown in FIG. 4. Guide plates 136 and 138 each have a central annulus (not shown) which interconnects the interior regions of the three chamber portions, 144, 146 and 148. The upper end of upper chamber portion 148 is sealingly attached to riser support plate 122 such that riser support plate 122 forms a cap enclosing the upper portion of the air chamber of air spring 114. In like fashion, the lower portion of lower chamber section 144 is sealingly attached to mounting plate 118 and serves as a cap enclosing the lower portion of the air spring air chamber. A valve 150 is inserted through mounting plate 118 and provides a passage into the air chamber of air spring 114 for pressuring and depressuring the air spring and for sealing the air spring. An air can 152 which serves as an additional volume of chamber space is located at an unspecified but convenient location and attached to the hull of the TLP and connected by a hose or pipe 154 to valve 150.

After the tensioner shown in FIG. 6 is installed, a riser is made up and lowered through riser tensioning ring 132, passed between centering rollers 133 attached to hull strucure 111, and attached to the tensioner in the manner described above with reference to the preferred embodiment.

In operation the alternate embodiment of the invention as shown in FIG. 6 differs from the preferred embodiment in that when the upper portion 128 of riser 130 moves upward relative to the buoyant platform, riser support plate 122 moves away from mounting plate 118, that is air spring assembly 112 extends. Similar relative movement of the riser and platform causes the air spring assembly of the preferred embodiment to contract. In both embodiments the air spring of the air spring assembly will be in compression the entire time the tensioner supports the riser. But in the preferred embodiment, increased compression of the air spring results in an extending of the air spring assembly whereas in the alternate embodiment, an increase in compression of the air spring causes a contraction of the air spring assembly.

In the embodiments of the invention described above, air is used to pressurize the air spring and the air can, and "air" has been used in referring to certain elements and characteristics of the invention, including "air spring", "air spring assemblies", "air actuator", and "air tight". However, it is to be understood the scope of the invention is not limited to the use of air or to "air" devices but rather air has been referred to for the purpose of describing the preferred embodiment of the invention. Any gas or mixture of gases, which are otherwise available and suitable for use onboard a buoyant platform, may be used in the invention in place of or together with air and such gases and gas mixtures are included within the scope of our invention.

We claim:

1. An apparatus for supporting an elongate element from a buoyant offshore structure, comprising:

a mounting frame adapted to be affixed to said buoyant offshore structure;

a support connector adapted to be attached to an upper portion of said elongate element;

a bellows having an expandable interior chamber, a first end affixed to said support connector and a second end affixed to said mounting frame; and a valve means connected to said chamber whereby gas may be introduced into or removed from said expandable chamber.

2. The apparatus of claim 1 wherein said mounting frame includes at least one frame guide extending downward from said buoyant structure, said frame guide being affixed to said lower end of said chamber;

said support connector includes at least one support guide extending upward from said support connector and is affixed to said upper end of said chamber;

said bellows includes at least one bellows guide attached to said chamber, a portion of which bellows guide has at least two borehole passages therethrough which are external to said bellows chambers;

wherein said at least one frame guide and said at least one support guide each extend through a separate borehole passage in said bellows guide whereby lateral movement of said bellows guide with respect to said frame and support guides is substantially prevented.

3. The apparatus of claim 2 wherein said frame guides and said support guides are substantially parallel rods.

4. The apparatus of claim 3 wherein said frame guides are substantially parallel tubular members.

5. The apparatus of claim 2 wherein said lower end of said chamber is a member having a central annulus and includes a reservoir with an aperture, the periphery of said aperture being sealingly attached to said member and surrounding said aperture.

6. The apparatus of claim 5 wherein said chamber includes two or more elastomeric sleeves interconnected in a stacked fashion with one of said bellows guides between each two stacked elastomeric sleeves.

7. A riser tensioner for supporting a riser from a buoyant platform, comprising:

a mounting frame attachable to said buoyant platform;

a substantially cylindrical elastomeric bellows means, sealingly affixed at one end to an upper support plate and sealingly affixed at the other end to one surface of a lower support plate having a central aperture therethrough;

an accumulator chamber with an aperture in its chamber wall sealingly affixed to the other surface of said lower support plate, whereby the periphery of said aperture encompasses said central annulus of said lower support plate;

at least one borehole passage in said lower support plate located radially outward from said central annulus and external to said seal means;

a riser support element having means for supporting said riser;

a first guide member affixed to said riser support means and extending upward therefrom and passing through one of said borehole passages with its other end attached to said upper support plate;

at least one borehole passage in said upper support plate;

a second guide member attached at one end to said mounting frame and extending downward therefrom in a substantially parallel fashion to said first guide member and passing through said borehole passage in said upper support plate and thereafter affixed to said lower support plate; and a valve means operatively connected to said reservoir chamber whereby gas may be pumped into said reservoir chamber thereby causing said bellows means to expand whereby said upper support plate moves in a direction substantially opposite to said lower support plate and said first and second rods prevent lateral movement with respect to said rods of said upper support plate and said lower support plate.

8. A tensioned riser system for a buoyant offshore platform, comprising:

a substantially vertical riser having an upper and a lower end, said lower end being secured proximate the ocean bottom and said upper end being proximate said offshore platform;

a first load transmitting structure secured to the upper end of said riser;

a second load transmitting structure secured to said offshore platform; and a gas spring having first and second end portions, said first end portion being secured to said first load transmitting structure and said second end portion being secured to said second load transmitting structure, said gas spring further having a convoluted elastomeric envelope extending between and sealingly secured to said end portions, said end portions and said envelope enclosing an internal air spring volume which expands in response to said end portions being moved apart and contracts in response to said end portions being moved together, said gas spring being free from seals which slide in response to relative movement of said first and second end portions.

9. The tensioned riser system as set forth in claim 8 wherein said system includes a plurality of gas springs, each of said gas springs having generally cylindrical and having a central axis generally parallel to the longitudinal axis of said riser, said gas springs being symmetrically disposed about said riser longitudinal axis.

10. The tensioned riser system as set forth in claim 9 wherein each of said gas springs communicates with a corresponding gas reservoir, whereby pressure changes within said gas springs as a result of contraction and extension of the gas springs are reduced.

11. The tensioned riser system as set forth in claim 10 wherein each of said accumulators is secured at one of said first and second ends of the corresponding gas spring.

12. A system for resiliently securing the upper end of a riser to a buoyant offshore platform, comprising:

a plurality of mounting assemblies, each having first and second opposed end portions, said first end portion being adapted to be secured to said buoyant offshore platform and said second end portion being adapted to be secured to said riser, said first and second end portions being adapted to move to and away from one another along a substantially vertical axis, said mounting assemblies being arranged in an array about the longitudinal axis of said riser; and a plurality of gas springs, each of said gas springs being mounted within a corresponding one of said mounting frames, said gas springs each having a first end portion secured to the first end portion of said corresponding mounting frame, and having a second end portion secured to the second end portion of said corresponding mounting frame, said gas spring being filled with pressurized gas whereby said first and second gas spring end portions are biased away from one another.

13. The system as set forth in claim 12 further including a gas reservoir in fluid communication with each of said gas springs.

14. The system as set forth in claim 12 wherein each mounting frame first end portion is a spaced vertical distance above the corresponding mounting frame second end portion and wherein each gas spring first end portion is a spaced vertical distance below the corresponding gas spring second end portion, whereby in response to said buoyant offshore platform moving in a direction away from said riser, said first and second gas spring end portions move toward one another, compressing said gas spring.

* * * * *